United States Patent [19]

Miyasaka et al.

[11] Patent Number: 4,908,303

[45] **Date of Patent: * Mar. 13, 1990**

[54] SILVER HALIDE PHOTOGRAPHIC MATERIALS SPECTRALLY SENSITIZED WITH LUMINOUS DYE

[75] Inventors: Tsutomu Miyasaka; Tadaaki Tani; Tadao Sugimoto, all of Kanagawa, Japan

[73] Assignee: Fuji Photo Film Co., Ltd., Minami-ashigara, Japan

[ * ] Notice: The portion of the term of this patent subsequent to Apr. 11, 2006 has been disclaimed.

[21] Appl. No.: 154,417

[22] Filed: Feb. 10, 1988

[30] Foreign Application Priority Data

Feb. 12, 1987 [JP] Japan ..... 62-28349
Feb. 12, 1987 [JP] Japan ..... 62-28350

[51] Int. Cl.[4] ..... G03C 1/12; G03C 1/28

[52] U.S. Cl. ..... 430/569; 430/139; 430/572; 430/574; 430/576

[58] Field of Search ..... 430/139, 569, 570, 572, 430/573, 574, 576

[56] References Cited

U.S. PATENT DOCUMENTS

| | | | |
|---|---|---|---|
| 2,735,766 | 2/1956 | Hill | 430/569 |
| 3,622,316 | 11/1971 | Bird et al. | 430/574 |
| 4,040,825 | 8/1977 | Steiger et al. | 430/570 |
| 4,183,756 | 1/1980 | Locker | 430/569 |
| 4,225,666 | 9/1980 | Locker et al. | 430/569 |
| 4,543,308 | 9/1985 | Schumann et al. | 430/139 |
| 4,683,193 | 7/1987 | Ihama et al. | 430/569 |
| 4,693,965 | 9/1987 | Ihama et al. | 430/569 |
| 4,820,606 | 4/1989 | Miyasaka et al. | 430/139 |

FOREIGN PATENT DOCUMENTS

| | | |
|---|---|---|
| 0112162 | 6/1984 | European Pat. Off. . |
| 2161053 | 7/1973 | France . |

OTHER PUBLICATIONS

Patent Abstracts of Japan, vol. 10, No. 53, p. 433, Mar. 4, 1986.

Patent Abstracts of Japan, vol. 10, No. 282, p. 500, Sep. 25, 1986.

*Primary Examiner*—Richard L. Schilling

*Attorney, Agent, or Firm*—Sughrue, Mion, Zinn, MacPeak & Seas

[57] ABSTRACT

A silver halide photographic material is disclosed containing at least one silver halide emulsion layer, in which (1) the silver halide grains constituting the emulsion layer have been spectrally sensitized by at least one adsorbable spectral sensitizing dye added thereto before the completion of chemical ripening of the grains, and (2) at least one luminous dye which has a quantum efficiency of 0.1 or more when the concentration thereof in dry gelatin at room temperature is $10^{-4}$ mol/dm$^3$ and which can be substantially completely removed by development is added to a hydrophilic dispersion medium for the emulsion layer exclusive of the silver halide grains in a concentration of 2.0 mmol/dm$^3$ in the dispersion medium. The addition of the spectral sensitizing dye is not limitative and can be either before the completion of the formation of the silver halide grains or during a stage from the completion of the formation of the grains to the completion of the chemical ripening thereof. By the combination of the spectral sensitization by the adsorbable spectral sensitizing dye and light-collecting sensitization by the luminous dye, the spectral sensitivity of the silver halide in the material is unexpectedly improved.

14 Claims, No Drawings

SILVER HALIDE PHOTOGRAPHIC MATERIALS SPECTRALLY SENSITIZED WITH LUMINOUS DYE

FIELD OF THE INVENTION

The present invention relates to a novel technique for color spectral sensitization of silver halide photographic materials. More precisely, it relates to a novel technique of incorporating a high concentration of a highly luminous dye into a dispersion medium for a light-sensitive silver halide emulsion to provide a silver halide photographic light-sensitive material whose spectral sensitivity has been extremely improved in the light absorption wavelength range of the luminous dye. Specifically, the subject matter of the present invention resides in a fundamental technique for spectral sensitization silver halide photographic materials in general, and the field of the present invention, therefore, broadly extends to any silver halide photographic material including both black-and-white photographic materials and color photographic materials irrespective of whether the same is of the negative type, positive type or reversal type.

BACKGROUND OF THE INVENTION

An adsorbable spectral sensitizing dye is generally used for spectral sensitization of silver halides, and the spectral sensitization of silver halides can be attained by the introduction of photoexcited electrons thereinto from the dye adsorbed on the surface of the silver halide.

As spectral sensitizing dyes there are widely used methine series dyes to which has been imparted adsorbability and which have an appropriate redox potential, for example, cyanines, merocyanines, complex cyanines and complex merocyanines. However, spectral sensitization with such adsorbing dyes is limited with respect to the spectral sensitization degree because of the limited amount of the sensitizing dye which is capable of being adsorbed on the surface of silver halides, and, further, it is known that the saturated adsorption or nearly saturated adsorption of the dye often causes extreme desensitization (color desensitization).

In view of the above, a method of spectral sensitization with non-adsorbing dye molecules in which adsorption of the dye on the surface of silver halides is not required but energy transference from a non-adsorbed dye molecule to an adsorbed sensitizing dye molecule is utilized for attaining spectral sensitization with a non-adsorbed dye molecule was developed. See, for example, Japanese Patent Application Nos. (OPI) 117619/76 and 239143/87 (the term "OPI" as used herein refers to a "published unexamined Japanese patent application") and Japanese Patent Application Nos. 284271/86 and 284272/86.

In accordance with such a method, silver halide grains are previously spectrally sensitized to optimum sensitivity with an adsorbed spectral sensitizing dye, and then an energy transferring type dye is added to the binder used in high concentration so that the desired increase in spectral sensitivity is attained utilizing the light-collecting effect of the energy transferring dye. Sensitization of this type is hereafter referred to as "light-collecting sensitization".

In light-collecting sensitization, a remarkable light-collecting effect can be attained in a system where the concentration of the energy transferring type dye (hereafter referred to as a "light-collecting dye" or "LC dye") in the emulsion binder is sufficiently high. In addition, regarding the adsorbing sensitizing dye which is an acceptor of energy, the use of tabular grains which have a large relative surface area and which can adsorb a large amount of dye in a high amount is effective for more efficiently attaining light-collecting sensitization. In other words, the emulsion system where a larger amount of the spectral sensitizing dye is adsorbed onto the emulsion grains is more effective for attaining sufficient light-collecting sensitization.

However, in accordance with the conventional light-collecting sensitization process, since the adsorbing spectral sensitizing dye which is an energy acceptor on silver halide is added to the emulsion in the last stage after the completion of the formation of the light-sensitive silver halide in a conventional manner for effecting spectral sensitization, adsorption of the dye to the surface of the silver halide is weak and, as a result, there are various problems which interfere with the light-collecting sensitization.

One of these problems is that a part of the spectral sensitization dye often remains free in the binder in the non-adsorbed state because of the weak adsorption power thereof and the free dye acts as a quenching agent to the LC dye in the binder so that the energy transfer to the adsorbed dye is prevented and the light-collecting sensitizing effect is lowered.

Another problem is that release of the spectral sensitizing dye often occurs when the amount of the dye generally exceeds about 50% of the saturated amount of the dye capable of being coated on the surface of the silver halide. As a consequence, the effective amount of the adsorbing spectral sensitizing dye as an energy acceptor is limited. This means a reduction of the amount of the sensitizing dye adsorbed onto the silver halide grains and, as a result, the light-collecting sensitizing effect is naturally limited.

Under these circumstances, the present inventors found that a silver halide emulsion can be more effectively sensitized by a light-collecting spectral sensitization method as described hereafter, in which the adsorption force of a spectral sensitizing dye, as an energy acceptor, onto silver halide grains is increased and the silver halide grains are sufficiently spectrally sensitized with the dye and are processed for light-collecting sensitization.

SUMMARY OF THE INVENTION

The first object of the present invention is to provide a silver halide photographic material in which the spectral sensitivity of the silver halide has been noticeably elevated by applying a non-adsorbing type luminous dye to silver halide grains whose spectral sensitivity has been increased by an adsorbing spectral sensitizing dye, for light-collecting sensitization.

The second object of the present invention is to provide a silver halide photographic material in which silver halide has been improved in spectral sensitivity by the application of an adsorbing spectral sensitizing dye thereto and which is able to adsorb a large amount of a dye with a small intrinsic desensitization and which has high sensitivity.

The third object of the present invention is to provide a silver halide photographic material of high sensitivity, in which a luminous dye used for light-collecting sensitization can easily be removed by the development processing with no aftercolor.

The above-mentioned objects of the present invention are attained by the use of a silver halide photographic material containing at least one silver halide emulsion layer, in which (1) the silver halide grains in the emulsion layer have been spectrally sensitized by at least one adsorbable spectral sensitizing dye added thereto before the completion of chemical ripening of the grains, and (2) at least one luminous dye which has a quantum efficiency of 0.1 to 1.0 when the concentration thereof in dry gelatin at room temperature is $10^{-4}$ mol/dm$^3$ and which can substantially be removed by development is added to the hydrophilic dispersion medium of the emulsion layer (exclusive of the silver halide grains) in a concentration of 2.0 mmol/dm$^3$ in the dispersion medium.

Regarding the addition of the adsorbable spectral sensitizing dye to the silver halide grains in the present invention, the stage for the addition can be grouped into two embodiments: "before the completion of the formation of the silver halide grains" and "from the completion of the formation of the grains to the completion of the chemical ripening thereof".

In accordance with the present invention, the adsorbable spectral sensitizing dye can be added to the silver halide grains at any stage of either of these two embodiments, with little difference between the two.

DETAILED DESCRIPTION OF THE INVENTION

For the addition of the adsorbable spectral sensitizing dye to the silver halide grains, the stage of "before the completion of the formation of the silver halide grains" means the stage during the formation of a silver halide precipitate by blending a soluble silver salt solution and a soluble halide solution and before the completion of the subsequent Ostwald ripening (physical ripening), which is followed by a further subsequent desalting step.

In accordance with one embodiment of the present invention, the adsorbable spectral sensitizing dye is required to be added at least before the completion of the formation of the silver halide grains. For example, all the spectral sensitizing dye can be added before the completion of the formation of the grains, or, alternatively, a part but not all of the spectral sensitizing dye is added before the completion of the formation of the grains and then the remaining spectral sensitizing dye is added in a subsequent step after the completion of the formation of the grains (for example, in a chemical ripening step, etc.), if desired.

On the other hand, the stage of "from the completion of the formation of the silver halide grains to the completion of the chemical ripening thereof" means the stage of from the completion of the desalting step, which follows the continuous procedure of blending a soluble silver salt solution and a soluble halide solution followed by Ostwald ripening of the resulting grains (physical ripening), to the completion of the chemical ripening of the grains. Specifically, this stage includes the period after the completion of the desalting and before chemical ripening and the period of during chemical ripening.

Accordingly, in another embodiment of the present invention, the adsorbable spectral sensitizing dye is added at the stage of from the completion of the formation of the silver halide grains to the completion of the chemical ripening thereof, but is not added before the completion of the formation of the grains.

In accordance with the present invention, the above-mentioned objects can be attained only by the action of the luminous dye as incorporated into the hydrophilic dispersion medium of the silver halide emulsion layer in high concentration. The luminous dye fully absorbs incident rays when introduced into the light-sensitive emulsion layer and then can transfer the absorption energy to the light-sensitive silver halide grains with no loss.

Utilizing such light-collecting effect, highly efficient light-collecting spectral sensitization can be attained in the present invention. In this respect, the luminous dye used in the present invention (which may be referred to as a "light-collecting dye" or "LC dye", as the case may be) is essentially different from dyes for anti-irradiation or antihalation. The main process for participating in the transmission of the light energy for light condensation is a Förster type intermolecular energy transmission (Th. Förster, *Disc. Farady Soc.*, Vol. 27, page 7, 1959), where the light condensation is effected by the intermolecular energy transmission of the luminous dye(s) and the subsequent energy transmission from the luminous dye molecules to the spectral sensitizing dye molecules adsorbed on the silver halides.

The luminous quantum efficiency, which is defined as 1.0 at maximum, of the LC dye for use in the present invention is required to be 0.1 to 1.0 when the concentration thereof in a dry gelatin medium at room temperature is $10^{-4}$ mol/dm$^3$, and this is preferably 0.3 to 1.0 and more preferably 0.5 to 1.0.

The quantum efficiency of the LC dye in a dry film can be measured basically by the same method as that for measurement of the quantum efficiency in a solution. In general, this can be obtained, with reference to standard samples whose quantum efficiency is known (for example, Rhodamine B, quinine sulfate, 9,10-diphenylanthracene, etc.), by the relative measurement of comparing the strength of the incident rays, the absorbance of the samples and the strength of the luminous light of the samples under a certain optical configuration. The method for such relative measurement is described, for example, in C. A. Parker and W. T. Rees, *Analyst*, Vol. 85, page 587 (1960).

Accordingly, the quantum efficiency of the LC dye in a dry gelatin in the present invention can easily be obtained by the above relative measurement with reference to a gelatin dry film (sheet-like sample) which contains a dispersion of a standard luminous dye of any desired concentration and has a known absolute value of quantum efficiency. Specifically, the quantum efficiency of a standard sample in a dry film is obtained by the following method.

Method of Measurement of Quantum Efficiency of Standard Sample

Fluorescent N-phenyl-1-naphthylamine-8-sulfonic acid, which is free from reabsorption because of overlapping of the absorption zone and the emission zone, was selected as the standard dye. Gelatin containing the thus selected standard dye was uniformly coated and dried on a transparent support to form a standard sample in which the dye concentration in the dry film was $10^{-2}$ mol/dm$^3$ and the amount of gelatin coated was 6 g/m$^2$. The sample was then set in the inside of an integrating sphere whose inner wall had been coated with a white powder ($BaSO_4$) and monochromatic exciting light of 380 nm was irradiated onto the sample.

The strength of the exciting light and that of the fluorescent light were measured by a photoelectric multiplying tube in the window of the integrating sphere, whereupon the light absorption percentage (A) of the sample was measured by comparing the strength of the exciting light in the case of the sample being present and in the case of the sample not being present, with a fluorescent light cutting filter equipped on the photoelectric multiplying tube.

With respect to the fluorescent component from the sample, the integrated fluorescent strength (F') was measured in the same manner with an exciting light cutting filter equipped in place of the fluorescent light cutting filter. The incident monochromatic light strength (I') was measured in the same measurement system as the integrated fluorescent strength (F') in the absence of the sample and the filter. The strength (F') and the strength (I') were converted into the true relative photon numbers (F) and (I), respectively, on the basis of the spectral transmittance of the exciting light cutting filter, the effective spectral reflectance of the integrating sphere, the spectral sensitivity of the photoelectric multiplying tube, etc., and then the quantum efficiency was calculated from the formula F/(I·A).

The quantum efficiency of the condensing dye, which is used in the present invention, in a dry gelatin film can be obtained by the relative measurement of the quantum efficiency of the dye on the basis of the standard sample having the known quantum efficiency which was measured as described above.

The luminous dye capable of imparting the light condensing function to the materials of the present invention is preferred to have a sufficiently small difference in the wavelength between the absorption peak and the emission peak, that is, to have a sufficiently small Stokes' shift, so that the overlapping of the emission zone and the absorption zone of the dye molecule is large, in view of the energy transmittance to be effected by the dye. For the purpose of elevating the light condensing efficiency, the preferred Stokes' shift is 0 to 40 nm, more preferably 0 to 20 nm, when the concentration of the dye in a dry gelatin film at room temperature is $10^{-4}$ mol/dm$^3$. From the viewpoint of the small Stokes' shift and the high quantum efficiency, cyanine dyes of a certain kind are preferred as the LC dye.

In addition, the emission zone of the luminous dye is required to at least partly overlap with the absorption zone of the adsorbable sensitizing dye, so that the luminous dye can efficiently transmit energy to the sensitizing dye adsorbed on the light-sensitive silver halide grains.

The luminous dye (LC dye) for use in the present invention may partly adsorb onto the silver halide grains in the emulsion layer. However, in order to effectively attain the light-collecting and sensitizing object of the present invention, it is required that a relatively large amount of the luminous dye uniformly exist in the hydrophilic dispersion medium, such as gelatin, etc., in the emulsion layer Therefore, the luminous dye is preferred to have high water solubility and weak adsorbability to the silver halide grains, and, in particular, it is more preferred to be substantially non-adsorbable The wording "substantially non-adsorbable" as herein referred to means that the amount of the luminous dye adsorbed to the outer surface of the (111) plane of a silver bromide emulsion is defined to be $5\times10^{-7}$ mol/m$^2$ or less (minimum is zero) in the form of a 5% (by weight) aqueous gelatin solution having a solution phase equilibrium concentration of $10^{-4}$ mol/liter at 40° C. and a pH of 6.5±0.05. The amount of the dye adsorbed can be obtained, for example, by the method of adding the dye to an emulsion containing 5% by weight of gelatin, stirring the resulting emulsion under irradiation of a safety lamp at 40° C. for 18 hours, separating the silver halide grains by centrifugal sedimentation and measuring the dye density of the resulting supernatant.

Regarding the water solubility of the luminous dye, it is preferred that the dye have a water solubility of $10^{-2}$ mol/liter or more at 25° C. and a pH of 7.0. Such high water solubility can be realized, for example, by the introduction of 4 or more water-soluble groups in one dye molecule. As water-soluble groups, sulfonic acid groups and carboxylic acid groups are especially preferred. By the introduction of 4 or more such anionic hydrophilic groups, high water solubility can be imparted to the dye while the dye is still substantially non-adsorbable onto silver halide. Accordingly, the dye can be dissolved and dispersed in a hydrophilic colloid in high concentration and can be rapidly and completely removed by conventional development or rapid development.

Although the highly water-soluble and substantially non-adsorbable LC dye is not limited to only molecules having the above mentioned structure, cyanine series dyes are especially preferred from the viewpoint that the introduction of the water-soluble groups is synthetically easy and luminous efficiency is high.

As LC dye for use in the present invention, cyanine series dyes are preferred, as mentioned above, in view of the quantum efficiency and the Stokes' shift. Regarding cyanine series dyes, the fluorescent efficiency thereof in a solution or in any other matrix is reported in D. F. O'Brien et al., *Photo. Sci. Eng.*, Vol. 18, page 76 (1974), and oxacarbocyanine derivatives are reported to have a fluorescent efficiency value of 0.75 in gelatin. For reference, as dyes having a high quantum efficiency, there may be typically mentioned the dyes having a skeleton structure for dye lasers. Examples of such dyes are summarized, for example, in M. Maeda, *Laser Studies*, Vol. 8, pages 694, 803 and 958 (1980), ibid., Vol. 9, page 85 (1981) and F. P. Schaefer, *Dye Lasers*, Springer (1973). Although most of these are naturally poor in water solubility, these may be converted into water-soluble diffusible dyes by the introduction of plural sulfonic acid or carboxylic acid groups or the like into their molecular structure, and the thus converted water-soluble diffusible dyes are preferably used as Light-collecting sensitizing dyes in the practice of the present invention.

Specific examples of LC dyes for use in the present invention are mentioned hereunder, which, however, are not limitative.

I. Water-soluble cyanine series dyes; Water-soluble merocyanine series dyes
II. Xanthene series dyes
III. Acridine series dyes
IV. Oxazine series dyes
V. Thiazine series dyes
VI. Riboflavin series dyes
VII. Triarylmethane series dyes
VIII. Aminonaphthalene series dyes
IX. Pyrene series dyes
X. Coumarin series dyes
XI. Porphyrin series dyes
XII. Phthalocyanine series dyes Specially preferred are the dyes of the groups I and II; and among group I are most preferred non-adsorbable type water-soluble cyanine series dyes. Among the group II dyes particularly preferred are water-soluble rhodamine derivatives (Rhodamine B, Sulforhodamine B, etc.) from the viewpoint of their high quantum efficiency.

Preferred examples of luminous dyes for use in the present invention are mentioned below, but the skeleton structure, substituents, etc., are not limited to those illustrated.

Formula I

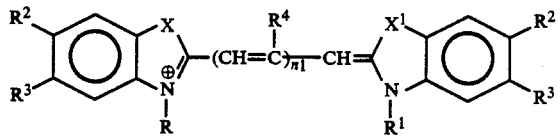

| | X | X¹ | R | R¹ | R² | R³ | R⁴ | $n_1$ |
|---|---|---|---|---|---|---|---|---|
| A-1 | O | O | $(CH_2)_4SO_3^{\ominus}$ | $(CH_2)_4SO_3Na$ | $CO_2Na$ | H | H | 1 |
| A-2 | O | O | " | " | $SO_3Na$ | H | H | 1 |
| A-3 | O | O | " | $(CH_2)_4SO_3K$ | H | Cl | H | 1 |
| A-4 | O | O | $(CH_2)_2SO_3^{\ominus}$ | $(CH_2)_2SO_3Na$ | $SO_2(CH_2)_2SO_3Na$ | H | H | 1 |
| A-5 | O | O | " | " | $SO_2NH(CH_2)_2SO_3Na$ | H | H | 1 |
| A-6 | O | O | $(CH_2)_3CO_2^{\ominus}$ | $(CH_2)_3CO_2H$ | $O(CH_2)_3SO_3H$ | $SO_3H$ | $CH_3$ | 1 |
| A-7 | O | O | $(CH_2)_3SO_3^{\ominus}$ | $(CH_2)_3SO_3Na$ | $CONH(CH_2)_2SO_3Na$ | H | H | 1 |
| A-8 | O | O | $(CH_2)_3SO_3^{\ominus}$ | $(CH_2)_3SO_3K$ | $N(CH_2CH_2SO_3K)_2$ | H | H | 1 |
| A-9 | O | O | $C_2H_5$ | $C_2H_5$ | $SO_3Na$ | $SO_3Na$ | H | 1 |
| A-10 | O | O | $(CH_2)_3SO_3^{\ominus}$ | $(CH_2)_3SO_3Na$ | H | Cl | H | 1 |
| A-11 | O | O | $(CH_2)_4SO_3^{\ominus}$ | $(CH_2)_4SO_3H$ | $CO_2H$ | H | — | 0 |
| A-12 | O | O | " | " | H | $SO_3H$ | H | 2 |
| A-13 | O | O | " | $(CH_2)_4SO_3K$ | H | H | H | 3 |
| A-14 | S | S | $(CH_2)_3SO_3^{\ominus}$ | $(CH_2)_3SO_3Na$ | H | $CO_2Na$ | H | 1 |
| A-15 | S | S | " | " | $SO_3Na$ | H | $CH_3$ | 1 |
| A-16 | S | S | $(CH_2)_2SO_3^{\ominus}$ | $(CH_2)_2SO_3Na$ | $SO_2(CH_2)_2SO_3Na$ | Cl | H | 1 |
| A-17 | S | S | " | " | $CONH(CH_2)_2SO_3Na$ | H | H | 1 |
| A-18 | S | S | $(CH_2)_3CO_2^{\ominus}$ | $(CH_2)_3CO_2H$ | $O(CH_2)_3SO_3H$ | H | H | 1 |
| A-19 | S | S | $(CH_2)_4SO_3^{\ominus}$ | $(CH_2)_4SO_3K$ | H | Cl | H | 1 |
| A-20 | S | S | $(CH_2)_4SO_3^{\ominus}$ | $(CH_2)_4SO_3Na$ | H | $CO_2Na$ | — | 0 |
| A-21 | S | S | " | " | $SO_3Na$ | H | — | 0 |
| A-22 | S | S | $(CH_2)_2SO_3^{\ominus}$ | $(CH_2)_2SO_3Na$ | $CO_2Na$ | $CO_2Na$ | H | 2 |
| A-23 | S | S | $(CH_2)_2SO_3^{\ominus}$ | $(CH_2)_2SO_3Na$ | $SO_3Na$ | H | H | 2 |
| A-24 | O | S | $(CH_2)_3SO_3^{\ominus}$ | $(CH_2)_3SO_3H$ | $CO_2H$ | H | — | 0 |
| A-25 | O | S | " | " | $SO_3Na$ | H | H | 1 |
| A-26 | O | S | " | " | H | Cl | H | 1 |
| A-27 | O | S | " | $(CH_2)_4SO_3Na$ | H | $O(CH_2)_2SO_3Na$ | H | 1 |
| A-28 | O | S | " | " | H | $SO_3Na$ | H | 2 |
| A-29 | O | S | " | " | $SO_3Na$ | H | $CH_3$ | 2 |

Formula II

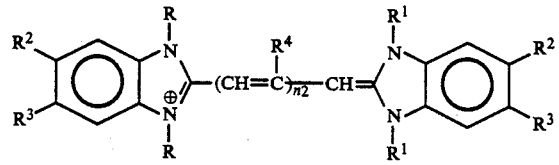

| | R | R¹ | R² | R³ | R⁴ | $n_2$ |
|---|---|---|---|---|---|---|
| A-30 | $(CH_2)_3SO_3^{\ominus}$ | $CH_2SO_3Na$ | $CF_3$ | H | H | 1 |
| A-31 | " | " | H | Cl | H | 1 |
| A-32 | " | " | $(CH_2)_4SO_3Na$ | H | H | 1 |
| A-33 | " | $CH_2CO_2K$ | $(CH_2)_4SO_3K$ | $(CH_2)_4SO_3K$ | $CH_3$ | 1 |
| A-34 | " | $(CH_2)_3SO_3K$ | $CF_3$ | H | H | 1 |
| A-35 | " | " | $CO_2K$ | H | H | 2 |
| A-36 | " | $CH_2CO_2K$ | H | Cl | H | 2 |
| A-37 | " | $CH_2CO_2H$ | H | H | H | 3 |

Formula III

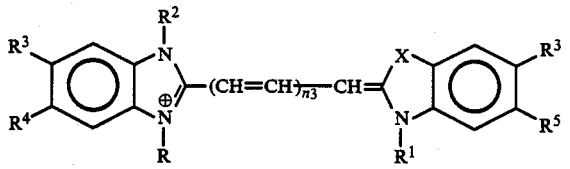

| | X | R | $R^1$ | $R^2$ | $R^3$ | $R^4$ | $R^5$ | $n_3$ |
|---|---|---|---|---|---|---|---|---|
| A-38 | S | $(CH_2)_4SO_3^{\ominus}$ | $(CH_2)_4SO_3K$ | $CH_2CO_2K$ | H | $CF_3$ | $CO_2K$ | 1 |
| A-39 | S | " | " | $(CH_2)_4SO_3K$ | $CO_2K$ | H | $CO_2K$ | 1 |
| A-40 | S | " | " | " | H | $(CH_2)_4SO_3K$ | $O(CH_2)_2SO_3K$ | 1 |
| A-41 | S | " | $C_2H_5$ | " | H | $CH_2CO_2K$ | $CH_2CO_2K$ | 1 |
| A-42 | S | $(CH_2)_3SO_3^{\ominus}$ | $(CH_2)_3SO_3Na$ | $CH_2CO_2Na$ | H | $CF_3$ | $SO_3Na$ | 2 |
| A-43 | S | " | " | " | H | Cl | " | 0 |
| A-44 | O | " | " | " | H | Cl | $CO_2Na$ | 1 |
| A-45 | O | $(CH_2)_2SO_3^{\ominus}$ | $(CH_2)_2SO_3Na$ | $CH_2SO_3Na$ | H | Cl | " | 2 |
| A-46 | O | " | " | " | H | Cl | " | 3 |

Formula IV

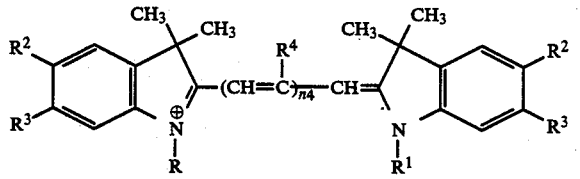

| | R | $R^1$ | $R^2$ | $R^3$ | $R^4$ | $n_4$ |
|---|---|---|---|---|---|---|
| A-47 | $(CH_2)_4SO_3^{\ominus}$ | $(CH_2)_4SO_3K$ | $SO_3K$ | H | H | 1 |
| A-48 | " | $(CH_2)_4SO_3H$ | $SO_3H$ | H | H | 1 |
| A-49 | " | " | $CH_2CO_2K$ | H | H | 1 |
| A-50 | $(CH_2)_2O(CH_2)_3SO_3^{\ominus}$ | $(CH_2)_2O(CH_2)_3SO_3K$ | $SO_3K$ | H | H | 1 |
| A-51 | $(CH_2)_3SO_3^{\ominus}$ | $(CH_2)_3SO_3Na$ | $(CH_2)_2CO_2Na$ | H | H | 1 |
| A-52 | " | " | H | Cl | H | 1 |
| A-53 | $C_2H_5$ | $C_2H_5$ | H | $SO_3Na$ | H | 2 |
| A-54 | $(CH_2)_3SO_3^{\ominus}$ | $(CH_2)_3SO_3Na$ | $CO_2Na$ | H | H | 2 |
| A-55 | " | " | $CH_2CO_2Na$ | H | — | 0 |
| A-56 | $(CH_2)_2CO_2^{\ominus}$ | $(CH_2)_2CO_2Na$ | $SO_3Na$ | H | — | 0 |

Formula V

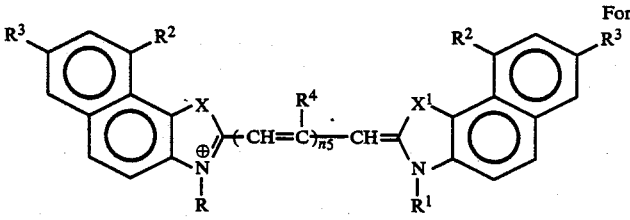

| | X | $X^1$ | R | $R^1$ | $R^2$ | $R^3$ | $R^4$ | $n_5$ |
|---|---|---|---|---|---|---|---|---|
| A-57 | O | O | $(CH_2)_3SO_3^{\ominus}$ | $(CH_2)_3SO_3Na$ | $SO_3Na$ | $SO_3Na$ | — | 0 |
| A-58 | O | O | " | " | " | " | $CH_3$ | 1 |
| A-59 | O | O | " | " | $CO_2Na$ | $CO_2Na$ | H | 2 |
| A-60 | S | S | $C_2H_5$ | $C_2H_5$ | $SO_3Na$ | $SO_3Na$ | H | 1 |
| A-61 | S | S | $CH_2CO_2^{\ominus}$ | $CH_2CO_2K$ | " | " | — | 0 |
| A-62 | O | S | $(CH_2)_4SO_3^{\ominus}$ | $(CH_2)_4SO_3K$ | " | " | H | 1 |
| A-63 | O | S | " | " | " | " | H | 2 |
| A-64 | $NCH_3$ | $NCH_3$ | " | " | " | " | H | 1 |
| A-65 | $NCH_3$ | S | " | " | " | " | H | 1 |
| A-66 | $NCH_3$ | O | " | " | " | " | H | 1 |

Formula VI
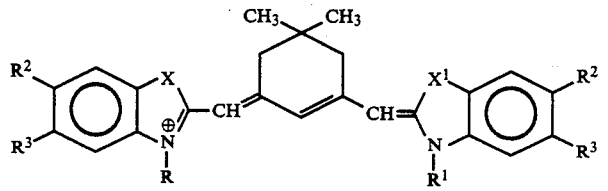
| | X | X¹ | R | R¹ | R² | R³ |
|---|---|---|---|---|---|---|
| A-67 | S | S | $(CH_2)_3SO_3^{\ominus}$ | $(CH_2)_3SO_3Na$ | $SO_3Na$ | H |
| A-68 | S | S | " | $(CH_2)_3SO_3K$ | $CO_2K$ | H |
| A-69 | S | O | " | " | H | $SO_3K$ |
| A-70 | S | O | " | " | $OCH_2SO_3K$ | H |
A-71
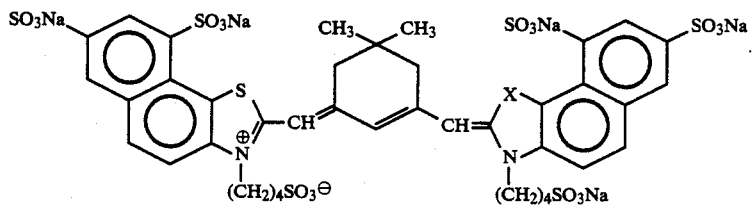
X = S, O
A-72
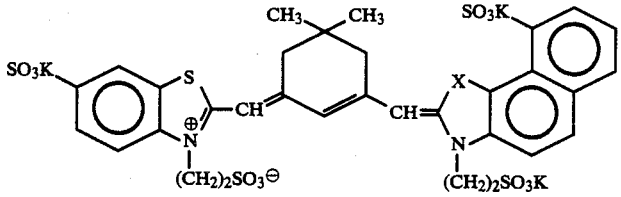
X = S, O
A-73
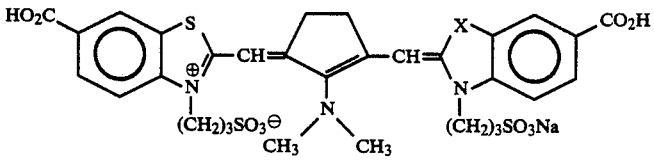
X = S, O
A-74
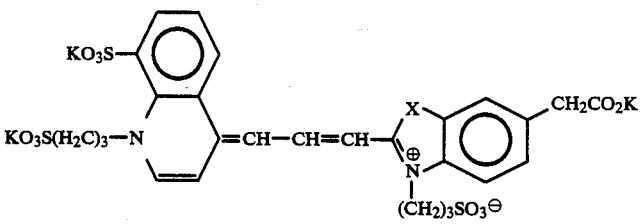
X = S, O
A-75
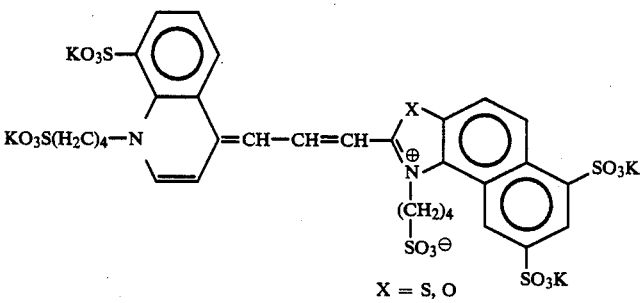
X = S, O -continued Formula VI

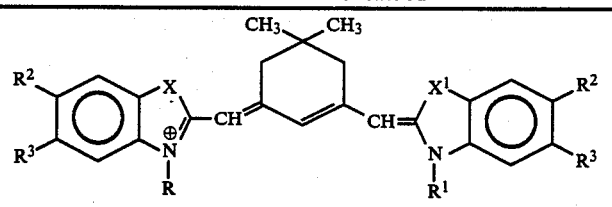

| X | X¹ | R | R¹ | R² | R³ |
|---|---|---|---|---|---|
| A-76 | | | | | |

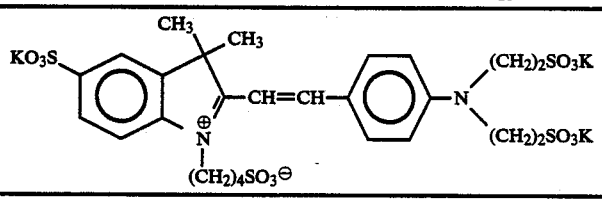

All of the above-mentioned LC dyes (A-1) to (A-76) are highly fluorescent and have a quantum efficiency of 0.1 or more as measured under the conditions as defined in the claims, and, in particular, dyes (A-1) to (A-11) and (A-47) to (A-54) have a high quantum efficiency of 0.7 to 1.0.

The above-mentioned cyanine dyes for use in the present invention can be produced on the basis of known methods, for example, by the methods as described in F. M. Hamer, *The Cyanine Dyes and Related Compounds*, Interscience, New York (1964). Typical examples for production of the dyes are described hereunder.

Production of Compound (A-1)

6.3 g of 4-(6-carboxy-2-methylbenzoxazolio-3)butanesulfonate, 12 g of ethyl orthoformate, 18 ml of pyridine and 7 ml of acetic acid were put in a 100 ml flask equipped with a stirrer and then were heated and stirred in an oil bath which had previously been heated to 140° C. for 1.3 hours. Then the system was permitted to cool and the crystals precipitated were taken out by filtration. The crystals were first washed with acetone and then with methanol, and thereafter dissolved in methanol to which had been added triethylamine. The resulting insoluble substance was removed by filtration, and then a methanol solution of sodium iodide was added to the resulting solution and the precipitated crystals taken out by filtration. They were further washed under heat with methanol. The crystals formed were dried under reduced pressure to obtain the intended product. Yield: 4.11 g (58.5%). m.p. 300° C. or higher. $\lambda MeOH_{max}=496$ nm ($\epsilon=1.32\times10^5$).

Production of Compound (A-47)

69 g of 4-(2,3,3-trimethyl-5-sulfo-3H-indolio-3)butanesulfonate, 55 ml of ethyl orthoformate, 69 ml of acetic acid and 150 ml of pyridine were put in a 1 liter flask equipped with a stirrer, and heated and stirred in an oil bath which had previously been heated to 140° C. for 1 hour. After the contents were left to cool to room temperature, 400 ml of acetone was added, the supernatant was removed by decantation, and the residue was dissolved in 500 ml of methanol. A methanol solution of potassium acetate was added to the resulting solution and the same heated under reflux for 10 minutes. The crystals precipitated were taken out by filtration and washed with isopropanol. They were repeatedly reprecipitated with water and isopropanol, and the crystals formed dried under reduced pressure to obtain the intended product. Yield: 41.2 g (52.3%), m.p. 330° C. or higher. $\lambda MeOH_{max}=555$ nm ($\epsilon=1.33\times10^5$).

In one preferred embodiment of the silver halide photographic material of the present invention, the light-sensitive silver halide is a dispersion of fine grains which have a layer of the spectral sensitizing dye adsorbed onto the surface thereof, whereby the silver halide grains are spectrally sensitized by the spectral sensitizing dye. In addition, a hydrophilic colloid medium such as gelatin or the like, which contains a uniform dispersion of LC dye molecule, exists around the adsorbed sensitizing dye layer, and the spectral sensitizing dye and LC dye are integrated with the above-mentioned light-sensitive silver halide to form the light-sensitive element. In this embodiment, the LC dye as dispersed in the hydrophilic colloid medium exists in such a state that almost all the chromophoric groups do not directly adsorb to the light-sensitive silver halide grains.

In the practice of the present invention, the time of the addition of LC dye may be at any time before the formation of the silver halide grains, during the formation of the grains, before the chemical ripening of the grains after the formation thereof, during chemical ripening, after chemical ripening, etc. The LC dye is preferably directly added to the silver halide emulsion containing the adsorbable spectral sensitizing dye.

In the photographic light-sensitive material of the present invention, the amount of LC dye added is 2.0 mmol/dm³ or more as concentration in the hydrophilic dispersion medium exclusive of the surface of silver halide grains in the emulsion, preferably 10 mmol/dm³ or more, and is more preferably 20 mmol/dm³ or more, where maximum concentration may be $10^{-1}$ mol/dm³. The wording "exclusive of the surface of silver halide grains" as used herein means that the sensitizing dye adsorbed onto the silver halide grains is excluded. Too high concentration of LC dye as added would cause saturation or lowering of the sensitizing efficiency, and, therefore, the concentration is preferred not to exceed $10^{-1}$ mol/dm³. The amount of the dye to be added per the total surface area of the silver halide grains in the emulsion layer is 3.0 μmol/m² or more, preferably 3.5 μmol/m² or more, more preferably 4.0 μmol/m² or more, where maximum is normally 100 μmol/m².

In the practice of the present invention, plural LC dyes can be used in mixture, provided that at least a part of the emission wavelength zone (at minimum 5 nm) of the dyes overlaps with the optical absorption zone of at least one sensitizing dye adsorbed onto the silver halide. It is preferred that the maximum emission wavelength of the molecule of the kind capable of generating the maximum emission in the longest wavelength range, among LC dyes, is positioned near the maximum absorption wavelength of the dye capable of transmitting the energy, among the adsorbable sensitizing dyes, and, in particular, this is desired to be positioned to the side of the short wavelength from the maximum absorption wavelength by the range of 0 to 60 nm, more preferably by the range of 0 to 30 nm. In addition, it is also preferred that the overlapping of the absorption zone and the emission zone as generated by the LC dye itself in the medium is large for Föroster type energy transference. Accordingly, the difference between the maximum absorption wavelength and the maximum emission wavelength, that is, the so-called Stokes' shift, is preferred to fall within the range of 0 to 40 nm, especially within the range of 0 to 20 nm.

For LC dye used in the present invention, a surfactant or other organic additives can be used as a solubilizer or an association-preventing agent.

In the practice of the present invention, the LC dye contained in the hydrophilic colloid layer can be mordanted with a cationic polymer, etc. For example, the polymers described in British Patent No. 685,475, U.S. Pat. Nos. 2,675,316, 2,839,401, 2,882,156, 3,048,487, 3,184,309 and 3,445,231, West German Patent Application (OLS) No. 1,914,362, Japanese Patent Applications (OPI) No. 47624/75 and 71332/75, etc., can be used for this purpose.

The LC dye used in the material of the present invention is required to be immediately removed from the photographic material by development or water rinsing or to be decomposed and bleached during processing. Typically, in a processing comprising a general series of alkaline development, bleaching, and water washing, the dye is washed out and released to a solution by development and decomposed to a colorless species in an alkaline development solution. In particular, dyes of a type which may be decolored by hydrolysis or the like in an alkaline processing solution after removal from the material are preferred.

From electrochemical viewpoint, the LC dye for use in the present invention is preferred to have a reduction potential in a solution of water/ethanol (1/1, by volume) which is more negative than −1.0V with respect to a saturated calomel reference electrode, in order that the dye does not act a desensitizer when adsorbed to a silver halide surface. The method for the measurement of the reduction potential of the dye can be carried out in accordance with the method described in T. Tani, *Electric Chemistry,* Vol. 34, page 149 (1966).

As the hydrophilic dispersion medium for the emulsion layer or interlayer(s) of the photographic light-sensitive material of the present invention, gelatin is advantageously used, but other hydrophilic colloids can of course be used. For example, proteins such as gelatin derivatives, graft polymers of gelatin and other high polymers, casein, etc.; cellulose derivatives such as hydroxyethyl cellulose, carboxymethyl cellulose, cellulose sulfates, etc.; saccharide derivatives such as sodium alginate, starch derivatives, etc.; and various kinds of synthetic hydrophilic polymer substances of homo- or copolymes, such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc., can be used.

As gelatin, lime-processed gelatin as well as acid-processed gelatin or the enzyme-processed gelatin as described in *Journal of the Society of Photographic Science and Technology of Japan,* No. 16, p. 30 (1966) can be used. Also, hydrolyzed products of gelatin can be used.

The light-sensitive silver halide composition for use in the present invention may be any one which can be used in conventional silver halide emulsions, including silver bromide, silver iodobromide, silver chloride, silver chlorobromide, silver chloroiodobromide, etc.

The shape of the light-sensitive silver halide grains may variously be spherical, tabular, octahedral, cubic, tetradecahedral, amorphous, etc. In particular, tabular grains are especially preferred, which have a large dye adsorbing area and can attain high spectral sensitization. Especially, a tabular grain silver halide emulsion where tabular silver halide grains having an aspect ratio (length/thickness) of 5 or more, in particular, 8 or more, account for at least 50% of the total project area of the silver halide grains is more preferred among the tabular grains. For example, the tabular grains described in *Research Disclosure* (RD) No. 22534 (1983), Japanese Patent Applications (OPI) Nos. 127921/83 and 99433/84 and U.S. Pat. No. 4,585,729 are preferably used.

The silver halide composition in the grains having the above-mentioned shape may be either uniform or non-uniform. As examples of the non-uniform composition, two-layer grains having different compositions in the center part and in the surface part, which are described in Japanese Patent Applications (OPI) Nos. 113926/83, 113927/83 and 99433/84, are also preferably used.

The mean grain size of the silver halide grains to be used in the emulsion layer is not specifically limitative but is preferably 3 μm or less as the diameter of the corresponding sphere and is especially preferably 1.8 μm or less. The grain size distribution may be either narrow or broad.

The silver halide grains for use in the present invention may differ in the phase composition between the inside and the surface thereof or they may have a uniform phase composition throughout the whole grain. The grains may be such as can form a latent image mainly on the surface part thereof or may be such as can form a latent image mainly in the inside thereof.

The silver halide grains may also be formed or physically ripened in the presence of a cadmium salt, a zinc salt, a lead salt, a thallium salt, an iridium salt or a complex salt thereof, a rhodium salt or a complex salt thereof, an iron salt or a complex salt thereof, etc.

As the silver halide emulsion there can be used a so-called primitive emulsion which has not been chemically ripened in the present invention, but, in general, the emulsion is preferably chemically ripened in a conventional manner for use in the present invention. For the chemical sensitization of the silver halide emulsion for use in the present invention, the method described in H. Frieser, *Die Grundlagen der Photographischen Prozesse mit Silberhalogeniden* (published by Akademische Verlagsgesellschaft, 1968), pages 675 to 734 can be utilized.

For example, a sulfur sensitization method using active gelatin or a sulfur-containing compound capable of reacting with silver (e.g., thiosulfates, thioureas, mercapto compounds, rhodanines, etc.), a reduction sensitization method using a reducing material (e.g., stannous salts, amines, hydrazine derivatives, formamidine sulfinic acid, silane compounds, etc.), a noble metal sensitization method using a noble metal compound (e.g., gold complex salts and complex salts of metals belonging to group VIII of the Periodic Table, such as platinum, iridium, palladium, etc.), etc., can be used individually or as a combination thereof.

The especially preferred sensitization method for the practice of the present invention is a combination of sulfur sensitization and gold sensitization, and as the sulfur sensitizing agent preferred are thiosulfates, thioureas, thioethers, etc., and as the gold sensitizers preferred are a mixture of chloroauric acid and gold ligand compounds such as thiocyanates, etc.

The chemical sensitization is preferably carried out under the conditions of a pAg value of from 5 to 10, a pH value of from 5 to 8 and a temperature of from 40° C. to 80° C.

When gold and sulfur are used together, the molar ratio of gold to sulfur is preferably selected from the range of from 0.01 to 10.

As preferred examples of the chemical sensitization, the methods described in *Research Disclosure* (RD) No. 12008 (April, 1974), ibid., No. 13452 (June, 1975), ibid., No. 17643 (December, 1978), etc., may be referred to.

The light-sensitive silver halide for use in the present invention is spectrally sensitized with the adsorbable spectral sensitizing dye. The word "adsorbable" as referred to herein means that the amount of the dye to be adsorbed to the surface of the silver halide grains is preferably larger than $5\times10^{-7}$ mol/m$^2$ when the dye is in an aqueous 5% (by weight) gelatin solution at 40° C. and at a pH of 6.5±0.05 having a solution equilibrium concentration of 10 mol/liter. More preferably, the amount of the dye adsorbed is larger than $5\times10^{-7}$ mol/m$^2$ when the solution equilibrium concentration is $10^{-5}$ mol/liter. In this case, the surface-coating percentage of the adsorbable dye over the silver halide is preferably more than 20%, more desirably more than 40%, of the amount of the saturated mono-molecular adsorption.

When the spectral sensitizing dye is used as a sensitizing dye, the materials are conventional surface latent image type negative photographic light-sensitive materials and internal latent image-forming type direct positive photographic light-sensitive materials. In addition, there may be mentioned, for example, positive photographic light-sensitive materials of the type providing positive images by breakage of the surface fog nuclei under exposure to light, when the dye is used as an electron accepting type dye. In order to attain optimum spectral sensitization in accordance with the use of the photographic light-sensitive materials, any other adsorbable supersensitizing agent or other various kinds of additives (such as antifoggants, etc.) can also be used together with the adsorbable dye. As for the use of an LC dye, ratio of the amount of an LC dye to be added with respect to that of an adsorbable sensitizing dye is generally 1.0 to 80 and preferably 2.0 to 50.

The adsorbable dyes for spectral sensitization in the present invention include cyanine dyes, merocyanine dyes, complex cyanine dyes, complex merocyanine dyes, holopolar cyanine dyes, hemicyanine dyes, styryl series dyes, hemioxonol series dyes, xanthene series dyes, triarylmethane series dyes, phenothiazine series dyes, acridine series dyes, metal chelate compounds, etc. Especially preferred dyes are cyanine dyes, merocyanine dyes and complex merocyanine dyes. These dyes can involve various nuclei which are usually utilized for cyanine dyes as basic heterocyclic nuclei. That is, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei, pyridine nuclei, etc.; the nuclei obtained by fusing aliphatic hydrocarbon rings to these nuclei and the nuclei obtained by fusing aromatic hydrocarbon rings to these nuclei, such as indolenine nuclei, benzindolenine nuclei, indole nuclei, benzoxazolone nuclei, naphthoxazole nuclei, benzothiazole nuclei, naphthothiazole nuclei, benzoselenazole nuclei, benzimidazole nuclei, quinoline nuclei, etc. Each of these nuclei may be substituted at one or more carbon atoms of the dye nuclei.

As the merocyanine dyes or complex merocyanine dyes there can be used 5-membered or 6-membered heterocyclic nuclei such as pyrazolin-5-one nuclei, thiohydantoin nuclei, 2-thiooxazolidine-2,4-dione nuclei, thiazolidine-2,4-dione nuclei, rhodanine nuclei, thiobarbituric acid nuclei, etc., as nuclei having a ketomethylene structure. As usable sensitizing dyes there may be mentioned various dyes as described in West German Patent No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent No. 1,242,588 and Japanese Patent Publication Nos. 14030/69 and 24844/77.

These sensitizing dyes can be used singly or as a combination thereof. A combination of sensitizing dyes is frequently used for the purpose of supersensitization. Specific examples of the super color sensitizing dyes are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patent Nos. 1,344,281 and 1,507,803, Japanese Patent Publication Nos. 4936/68 and 12375/78 and Japanese Patent Applications (OPI) Nos. 110618/77 and 109925/77.

The silver halide emulsions for use in the present invention may further contain, together with the sensitizing dye(s), dyes having no spectral sensitizing action by themselves or materials which do not substantially absorb visible light but show a supersensitizing effect. For example, the emulsions can contain a nitrogen-containing heterocyclic group-substituted aminostilbene compound (for example, the compounds described in U.S. Pat. Nos. 2,933,390 and 3,635,721), an aromatic organic acid/formaldehyde condensation product (for example, the products described in U.S. Pat. No. 3,743,510), a cadmium salt, an azaindene compound, etc. The combinations described in U.S. Pat. Nos. 3,615,613, 3,615,641, 3,617,295 and 3,635,721 are especially useful.

In the photographic light-sensitive materials of the present invention, at least one kind of the silver halide grains contained in at least one light-sensitive silver halide emulsion layer is spectrally sensitized by the addition of the photographic adsorbable spectral sensitizing dye thereto prior to the completion of chemical ripening of the grains.

In the procedure of the formation of the silver halide grains, soluble silver salt solution(s) and soluble halide solution(s) are generally reacted to cause the formation of the silver halide precipitate, and successively the precipitate is subjected to Ostwald ripening (physical ripening) and then to desalting.

With respect to the time when the spectral sensitizing dye is to be added to the medium in which the silver halide grains are being formed or have been formed, the dye can be added before the formation of the silver halide precipitates, or during the formation thereof, or during the time from the beginning of Ostwald ripening to the completion thereof (that is, before the beginning of the desalting step). The sensitizing dye can be added all at one time or can be added several times in divided portions, or this can be added continuously over a determined period of time.

As one embodiment of the addition of the spectral sensitizing dye, the dye can be added after the formation of stable nuclei of the silver halide grains (and preferably, the addition is completed before the precipitation of 85% by weight of the total amount of the silver halide), as described, for example, in U.S. Pat. No. 4,225,666.

As another embodiment of the addition, the dye is added during the time before the precipitation of from 85 to 95% by weight of the total amount of the silver halide, as disclosed in Japanese Patent Application (OPI) No. 103149/86.

As still another embodiment of the addition, the dye may be added simultaneously with the completion of the formation of the precipitate or during the time from the completion of the formation to before the beginning of the desalting step via the Ostwald ripening.

The most pertinent method can appropriately be selected from these methods, in accordance with the composition of the silver halide grains used and the shape and the property thereof.

With respect to the means of the addition of the spectral sensitizing dye, it can be dissolved in an appropriate solvent and then added to the emulsion, as described, for example, in U.S. Pat. Nos. 2,735,766, 3,628,960, 4,183,756 and 4,225,666, or alternatively, the dye can be added in the form of a solid powder or in the form of a suspension containing an insoluble dye as dispersed in a solution. In the addition, a binder and various other kinds of additives such as an antifoggant, a pH adjusting agent, a surfactant, etc., which are mentioned below, can be incorporated into the solution or suspension to which the sensitizing dye is to be added, if desired.

The amount of the spectral sensitizing dye to be added to the silver halide emulsion is preferably from 0.01 to 10 mmol, more preferably from 0.1 to 1 mmol, per mol of silver halide. The surface-coating percentage (maximum is 100%) of the dye over the silver halide, resulting from the addition of the dye, is preferably at least 20% or more, more preferably 40% or more, of the amount of the saturated monomolecular adsorption.

In another embodiment of the present invention, the silver halide grains to which the spectral dye was added during chemical ripening of the grains can be incorporated into the light-sensitive emulsion layer singly or in the form of a mixture with other conventional light-sensitive silver halide grains which were chemically ripened in the absence of the spectral sensitizing dye.

The silver halide photographic emulsion for use in the present invention can contain, together with the spectral sensitizing dye, various kinds of compounds for the purpose of prevention of fog and of stabilization of photographic characteristics during manufacture, storage and photographic processing of the photographic light-sensitive materials.

For example, various kinds of compounds which are known as antifoggants or stabilizers can be used for such purpose, including, for example, azoles such as benzothiazolium salts, nitroimidazoles, nitrobenzimidazoles, chlorobenzimidazoles, bromobenzimidazoles, mercaptothiazoles, mercaptobemzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), etc.; mercaptopyrimidines; mercaptotriazines; thioketo compounds such as oxazolinethione, etc.; azaindenes such as triazaindenes, tetraazaindenes (especially, 4-hydroxy-substituted (1,3,3a,7)tetraazaindenes), pentaazaindenes, etc.; benzenethiosulfonic acid, benzenesulfinic acid, benzenesulfonic acid amide, etc.

The photographic emulsion for use in the present invention can further contain, for the purpose of elevation of sensitivity, elevation of contrast and acceleration of development, polyalkylene oxides or ethers, esters or amine derivatives thereof, thioether compounds, thiomorpholines, quaternary ammonium salt compounds, urethane derivatives, urea derivatives, imidazole derivatives, 3-pyrazolidones, etc.

When the present invention is applied to color photographic materials, various kinds of color couplers can be used. The term "color coupler" herein means a compound capable of forming a dye by a coupling reaction with the oxidation product of an aromatic primary amine developing agent. Typical examples of usable color couplers include naphthol or phenol series compounds, pyrazolone or pyrazoloazole series compounds and open chain or heterocyclic ketomethylene compounds. Specific examples of these cyan, magenta and yellow couplers which can be used in the present invention are described in *Research Disclosure* (RD) No. 17643 (December, 1978), Item VII-D and ibid., No. 18717 (November, 1979) and the patent publications referred to therein.

Various kinds of couplers for use in the present invention may be used in the same photographic layer of the color photographic material as a combination of two or more kinds thereof for meeting particular characteristics desired for the color photographic material, or the same kind of coupler may be used for two or more photographic layers for meeting desired characteristics.

In order to correct the unnecessary absorption in the short wavelength range of the dyes formed from magenta and cyan couplers, a colored coupler is preferably used together with the magenta or cyan coupler in color negative photographic materials for picture taking. Specific examples of colored couplers are the yellow colored magenta couplers described in U.S. Pat. No. 4,163,670 and Japanese Patent Publication No. 39413/82, the magenta colored cyan couplers described in U.S. Pat. Nos. 4,004,929 and 4,138,258 and British Patent No. 1,146,368, etc.

In the present invention, by using couplers giving colored dyes having a proper diffusibility together with the aforesaid color couplers, the graininess of color images formed can be improved. Specific examples of magenta couplers giving such diffusible dyes are described in U.S. Pat. No. 4,366,237 and British Patent No. 2,125,570 and specific examples of yellow, magenta and cyan couplers of this type are described in European Patent No. 96,570 and West German Patent Application (OLS) No. 3,234,533.

The dye-forming couplers and the above-mentioned specific couplers for use in the present invention may form dimers or higher polymers. Typical examples of polymerized dye-forming couplers are described in U.S.

Pat. No. 3,451,820 and 4,080,211. Also, specific examples of polymerized magenta couplers are described in British Patent No. 2,102,173, U.S. Pat. No. 4,367,282, Japanese Patent Applications (OPI) Nos. 232455/86 and 54260/87.

In addition, couplers capable of releasing a photographically useful group upon coupling reaction can also be used in the present invention. As DIR couplers releasing a development inhibitor, the couplers described in the aforesaid *Research Disclosure,* 17643, Item VII-F are useful.

The photographic light-sensitive materials of the present invention can also contain a coupler capable of imagewise releasing a nucleating agent or development accelerator or a precursor thereof during development. Specific examples of such couplers are described in British Patent Nos. 2,097,140 and 2,131,188. In particular, a coupler releasing a nucleating agent or the like which has adsorbability to silver halide is especially preferred, and specific examples thereof are described in Japanese Patent Applications (OPI) Nos. 157638/84 and 170840/84, etc.

The photographic light-sensitive materials of the present invention can contain an inorganic or organic hardener in the photographic light-sensitive layer or in any desired hydrophilic colloid layer constituting the backing layer. Specific examples of the hardener include chromium salts, aldehyde salts (formaldehyde, glyoxal, glutaraldehyde, etc.) and N-methylol series compounds (dimethylolurea, etc.). Active halogen compounds (2,4-dichloro-6-hydroxy-1,3,5-triazine, etc.) and active vinyl compounds (1,3-bisvinylsulfonyl-2-propanol, 1,2-bisvinylsulfonylacetamidoethane or vinyl series polymers having a vinyl sulfonyl group in the side chain, etc.) are preferred, as these can rapidly harden the hydrophilic colloid such as gelatin to give stable photographic characteristics to the material. N-carbamoyl pyridinium salts and haloamidinium salts are also excellent in their rapid hardening speed.

The silver halide emulsion for use in the present invention can contain any other various kinds of additives. For example, it can contain a surfactant, a viscosity increasing agent, a dye, an ultraviolet absorbent, an antistatic agent, a brightening agent, a desensitizing agent, a developing agent, a color fading preventing agent, a mordant agent, etc.

These additives are described in *Research Disclosure,* 17643, Vol. 176, pages 22 to 31 (December, 1978); T. H. James, *The Theory of the Photographic Process* (4th Ed.), published by Macmillan Publishing Co., Inc., etc.

For the manufacture of the photographic light-sensitive materials of the present invention, the photographic emulsion layer and other layers are coated on a flexible support, such as a plastic film, paper, cloth, etc., or a rigid support, such as glass, porcelain, metal, etc., which is generally used for the manufacture of photographic light-sensitive materials.

Useful flexible supports are films made of semi-synthetic or synthetic polymers, such as cellulose nitrate, cellulose acetate, cellulose acetate-butyrate, polystyrene, polyvinyl chloride, polyethylene terephthalate, polycarbonate, etc., or paper coated or laminated with a baryta layer or an $\alpha$-olefin polymer (e.g., polyethylene, polypropylene, ethylene/butene copolymer), etc. The support can be colored with a dye or pigment. This can be blackened for the purpose of light shielding. The surface of the support is generally coated with a subbing layer so as to improve adhesiveness to photographic layers, etc. In addition, the surface of the support can be processed by glow discharge, corona discharge, ultraviolet irradiation or flame treatment, before or after the provision of the subbing layer.

The exposure for the formation of photographic images can be carried out in a conventional manner. For example, any various known light sources, including natural light (sunlight), a tungsten lamp, fluorescent lamp, mercury lamp, xenon arc lamp, carbon arc lamp, xenon flash lamp, cathode ray flying spot, etc., can be used. Regarding the exposure time, not only natural exposure of from 1/1,000 second to 1 second, which is usual for conventional cameras, but also a shorter exposure than 1/1,000 second, for example, from $1/10^4$ to $1/10^9$ second by the use of xenon flash lamp or cathode ray or laser ray, may be applied, or a longer exposure than 1 second can be applied. If desired, a color filer can be used so as to adjust the spectral composition of the light for the exposure. Further, the materials can also be exposed with light as emitted from a fluorescent material excited by electron rays, X-rays, $\gamma$-rays, $\alpha$-rays, etc.

Any known methods and known processing solutions, for example, as described in *Research Disclosure,* 17643, Vol. 176, pages 28 to 30, can be applied to the photographic processing of the photographic light-sensitive materials as defined in the present invention. The photographic processing may be either black-and-white photographic processing for the formation of silver images or color photographic processing for the formation of color images in accordance with the object of the photographic materials to be processed. The processing temperature is generally selected from between 18° C. and 50° C., but it may also be a temperature lower than 18° C. or a temperature higher than 50° C.

As a special system for development, a method of processing the photographic light-sensitive material into which a developing agent was previously incorporated, for example, in the emulsion layer thereof, with an aqueous alkaline solution for development can also be applied to the photographic light-sensitive materials of the present invention. Among the developing agents, those which are hydrophobic can be incorporated into the emulsion layer by various known methods, for example, as described in *Research Disclosure,* 16928, U.S. Pat. No. 2,739,890, British Patent No. 813,253, West German Patent No. 1,547,763, etc. The development can be effected in combination with silver salt stabilization in the presence of a thiocyanate.

As a fixing solution, one having a conventional composition can be used. As the fixing agent, thiosulfates and thiocyanates as well as other organic sulfur compounds which are known to have an effect as a fixing agent can be used. The fixing solution can contain a water-soluble aluminum salt as a hardener.

The color developer used for the color development of the photographic light-sensitive materials of the present invention may be an aqueous alkaline solution containing a color developing agent. As the color developing agent there can be used known aromatic primary amine developing agents, including, for example, phenylenediamines (such as 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.).

In addition, the compounds described in L. F. A. Mason, *Photographic Processing Chemistry* (published by Focal Press, 1966), pages 226 to 229, U.S. Pat. Nos. 2,193,015 and 2,592,364, Japanese Patent Application (OPI) No. 64933/73, etc., can also be used.

The color developer can further contain a pH buffer, a development inhibitor, an antifoggant, etc. In addition, it may also contain, if desired, a water softener, a preservative, an organic solvent, a development accelerator, a dye forming coupler, a competing coupler, a fogging agent, an auxiliary developing agent, a tackifier, a polycarboxylic acid series chelating agent, an antioxidant, etc.

Examples of these additives are described, for example, in *Research Disclosure,* 17643, U.S. Pat. No. 4,083,723, West German Patent Application (OLS) No. 2,622,950, etc.

After color development, the photographic emulsion layer is generally bleached. The bleaching can be carried out simultaneously with fixing or separately therefrom. As the bleaching agent there can be used compounds of polyvalent metals such as iron(III), cobalt(III), chromium(VI), copper(II), etc., as well as peracids, quinones, nitroso compounds, etc.

For example, ferricyanides; bichromates; organic complex salts of iron(III) or cobalt(III), such as complexes with an aminopolycarboxylic acid (e.g., ethylenediaminetetraacetic acid, nitrilotriacetic acid, 1,3-diamino-2-propanoltetraacetic acid, etc.) or with an organic acid (e.g., citric acid, tartaric acid, malic acid, etc.); persulfates, permanganates; nitrosophenol, etc., can be used. In particular, potassium ferricyanide, sodium ethylenediaminetetraacetic acid salt/iron(III) complex and ammonium ethylenediaminetetraacetic acid/iron(III) complex are especially preferred. Ethylenediaminetetraacetic acid/iron(III) complex salts can be used both in an independent bleaching solution or in a combined bleach-fixing solution.

The bleaching solution or bleach-fixing solution can contain a bleaching accelerator as described in U.S. Pat. Nos. 3,042,520 and 3,241,966, Japanese Patent Publications Nos. 8506/70 and 8836/70, etc., the thiol compounds as described in Japanese Patent Application (OPI) No. 65732/78, etc., as well as other various kinds of additives.

In the processing of the photographic light-sensitive materials of the present invention, an additive capable of reacting with the LC dye, which had been added to the material, in order to decompose and decolor the LC dye, can be added to processing solutions such as the developer, bleach-fixing solution, etc.

The present invention can be applied to various color and black-and-white photographic light-sensitive materials. Specific examples of the materials include color negative films for general use or for movies, color reversal films for slides or for television, color papers, color positive films, color reversal films, color diffusion transfer type photographic materials, heat development type color photographic materials, etc.

By utilizing the three color coupler mixture described in *Research Disclosure,* 17123 (July, 1978) or by utilizing the black-coloring coupler described in U.S. Pat. No. 4,126,461, British Patent No. 2,102,136, etc., the present invention can also be applied to black-and-white photographic light-sensitive materials for X-ray use, etc. Also, the present invention can further be applied to photomechanical films such as lith films, scanner films, etc.; X-ray films for direct or indirect medical use or industrial use; negative black-and-white films for picture taking; black-and-white photographic papers; microfilms for COM or for general use; silver salt diffusion transfer type photographic light-sensitive materials; and printout type photographic light-sensitive materials.

The technique of the present invention is effective as a means for improving the spectrally sensitized sensitivity and, moreover, the LC dye itself as a sensitizing agent in the dispersion medium is a light absorbing agent. Accordingly, because of the anti-irradiation and antihalation effect of the LC dye, it is expected that the image sharpness of the photographic light-sensitive material can also be improved in addition to sensitization of the material. In general, the use of an anti-irradiation dye or an antihalation dye generally causes desensitization of the photographic light-sensitive material because of the light filter effect thereof. However, in accordance with the technique of the present invention, the sharpness can be improved without decreasing sensitivity but rather with increasing the same.

For example, in the direct X-ray photographic light-sensitive material formed by coating emulsion layers on both surfaces of a support, it is known that the fluorescent light penetrating from the fluorescent sensitized paper to the light-sensitive layer which is positioned opposite to the entrance surface, that is, the cross-over light, extremely interferes with the sharpness of the image formed. However, by the use of the technique of the present invention, the amount of the light absorbed on the entrance surface can remarkably be increased so that the sensitivity can be elevated and in addition the cross-over light can be shielded so that sharpness is expected to be noticeably elevated.

The following examples are intended to illustrate the present invention but not to limit it in any way.

EXAMPLE 1

38.0 ml of an aqueous solution containing 1.0 mol/liter of $AgNO_3$ and an aqueous solution containing 1.0 mol/liter of KBr were simultaneously added to 1.0 liter of an aqueous solution containing 0.1 mol of $NH_3$, 0.1 mol of $NH_4NO_3$, 1.4 mmol of KBr and 30 g of gelatin by a conventional double jet method over a period of 2 hours at 50° C., with stirring. During the addition, the flow rate of the KBr-containing solution was controlled so that the pAg in the reaction system was kept to be 8.3. An appropriate amount of $AgNO_3$ was added so that the pAg was adjusted to 7.4, and then 714.0 ml of an aqueous solution containing 1.0 mol/liter of AgNO and an aqueous solution containing 1.0 mol/liter of KBr were simultaneously added over a period of 38 minutes, with controlling the flow rate of the KBr-containing solution so that the pAg of the reaction system was kept to be 7.4, to obtain a monodispersed emulsion (a) containing cubic AgBr grains having a mean grain edge length of 0.7 μm. In the simultaneous addition of the second stage of the procedure, after the solutions were added at the same flow rate for 28 minutes, 90 ml of a methanol solution containing 0.004 mol/liter of sensitizing dye (S-1) was added to the emulsion ad then the simultaneous addition was carried out for a further 10 minutes without varying the flow rate. Thus, a monodispersed emulsion (b) containing cubic AgBr grains having a mean grain edge length of 0.7 μm was obtained.

Each of emulsion (a) and emulsion (b) were chemically sensitized with sodium thiosulfate, the amount of which was from 0.1 to 0.3 mg per gram of the silver, for 40 minutes at 56° C. so as to impart the maximum sensitivity thereto, to give a light-sensitive AgBr emulsion (Ib) and a light-sensitive AgBr emulsion (Ib), respectively. After the chemical sensitization, sensitizing dye (S-1) was added to the emulsion (Ia) in an amount of $3.0\times10^{-4}$ mol per mol of the AgBr in the form of a methanol solution, whereby emulsion (Ia) was ripened for 10 minutes at 40° C. for spectral sensitization.

4-Hydroxy-6-methyl-1,3,3a,7-tetraazaindene was added to each of emulsion (Ia) and emulsion (Ib) as a stabilizer in an amount of $2.5\times10^{-3}$ mol per mol of AgBr, and then an aqueous solution of the abovementioned compound (A-47) as an LC dye was added thereto in a concentration (per the dry amount of the binder gelatin) of 1 mmol/dm$^3$, 2 mmol/dm$^3$, 10 mmol/dm$^3$ or 20 mmol/dm$^3$. A conventional coating assistant agent and gelatin were added to the emulsion thus sensitized by light-collecting sensitization, and the resulting emulsion was uniformly coated on a polyethylene terephthalate support in an amount of 2.0 g/m$^2$ as silver or in an amount of 4.0 g/m$^2$ as gelatin and dried to obtain various light-sensitive emulsion-coated samples.

The fluorescent quantum efficiency of LC dye (A-47) as used herein, in a concentration of $10^{-4}$ mol/dm$^3$ in a dry gelatin film, was 0.8, which was measured by means of the earlier described method. The Stokes' shift of the light emission under the condition was 13 nm.

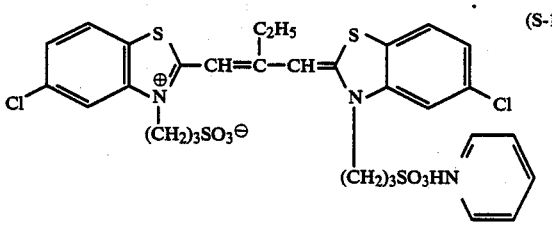

(S-1)

Each sample was exposed to a white light from a 1 kw tungsten lamp (color temperature: 4,800° K.) through an optical wedge for 1/10 second on the one hand and was exposed to monochromatic light through an interference filter of 530 nm wavelength, which is involved in the light absorption of LC dye (A-47), for 1 second, on the other hand, and the thus-exposed sample was developed with the developer having the composition as mentioned below, for 10 minutes at 20° C. By the development, LC dye (A-47) was completely washed out of the sample and removed therefrom with no aftercolor.

| Composition of Developer: | |
|---|---|
| Metol | 2.5 g |
| L-Ascorbic Acid | 10.0 g |
| Nabox | 35.0 g |
| Potassium Bromide | 1.0 g |
| Water to make | 1 liter |

The sensitivity of the negative image obtained as a result of the development was as shown in Table 1 below, together with the amount of the LC dye added to each sample. In the two emulsion series, the relative sensitivity of the sample is a relative value of the reciprocal of the exposure capable of giving a density of (fog density +0.2) on the basis of the standard value (100) of sample (1) and sample (6).

The results of Table 1 indicate that in both the series of emulsion (Ia) which had been spectrally sensitized after the formation of the grains in a conventional manner and the series of emulsion (Ib) which had been spectrally sensitized by adding the sensitizing dye during the formation of the grains, the resulting spectral sensitivity increased because of the light-collecting sensitization of LC dye (A-47), which has been added to the gelatin, at a light absorption wavelength 530 nm, and, in particular, the increase of the sensitivity was remarkable in the range of an LC dye concentration of 2 mmol/dm$^3$ or more, and accordingly, it can be seen that the LC dye used was remarkably effective also for elevation of white light sensitivity. Comparing the (Ib) series of the present invention and the emulsion (Ia) series formed by a conventional method, the effect of the light-collecting sensitization of the former was extremely large as compared to that of the latter at every concentration of the dye added, i.e., the light-collecting sensitization could be attained in the former even when the amount of LC dye added was small. Accordingly, in view of manufacturing cost and rinsing efficiency, it is apparent that the technique of the present invention is especially advantageous for effective and economical light-collecting sensitization.

TABLE 1

| Sample No. | Emulsion | LC Dye | Concentration of LC Dye in Gelatin (mmol/dm$^3$) | Relative Sensitivity White Light | Relative Sensitivity 530 nm |
|---|---|---|---|---|---|
| 1 (Comparison) | Ia | None | — | 100 | 100 |
| 2 (Comparison) | Ia | A-47 | 1 | 100 | 105 |
| 3 (Comparison) | Ia | A-47 | 2 | 103 | 120 |
| 4 (Comparison) | Ia | A-47 | 10 | 108 | 178 |
| 5 (Comparison) | Ia | A-47 | 20 | 110 | 200 |
| 6 (Comparison) | Ib | None | — | 100 | 100 |
| 7 (Comparison) | Ib | A-47 | 1 | 100 | 106 |
| 8 (Invention) | Ib | A-47 | 2 | 105 | 150 |
| 9 (Invention) | Ib | A-47 | 10 | 117 | 280 |
| 10 (Invention) | Ib | A-47 | 20 | 130 | 316 |

Maximum Absorption Wavelength of Sensitizing Dye (S-1): 655 nm
Maximum Emission Wavelength of LC Dye (A-47): 585 nm to 630 nm (This is shifted to the longer wavelength side with elevation of the concentration.)

EXAMPLE 2

600 ml of an aqueous solution containing 0.59 mol/liter of $AgNO_3$ and an aqueous solution containing 0.57 mol/liter of KBr and 0.024 mol/liter of KI were simultaneously added to 1.3 liters of water containing 0.22 mol of $NH_3$, 0.03 mol of $NH_4NO_3$, 3.3 mmol of KBr and 40 g of gelatin, by a conventional double jet method over a period of 60 minutes, with stirring at 70° C. and with controlling the flow rate of the potassium halide-containing solution so as to keep the pAg value at 7.86, whereby monodispersed emulsion (c) of octahedral silver iodobromide grains (iodine content 4 mol %) having a mean grain size (as the diameter of the corresponding sphere) of 0.7 μm was obtained. In the above simultaneous addition stage, after the solutions were added at the same flow rate for 50 minutes at a pAg of 7.86, 50 ml of a methanol solution containing 0.004 mol/liter of sensitizing dye (S-2) was added to the emulsion and then the simultaneous addition was carried out for a further 10 minutes without varying the flow rate. Thus, monodispersed emulsion (d) containing octahedral silver iodobromide grains (iodine content 4 mol %) having a mean grain size (as the diameter of the corresponding sphere) of 0.7 μm was obtained.

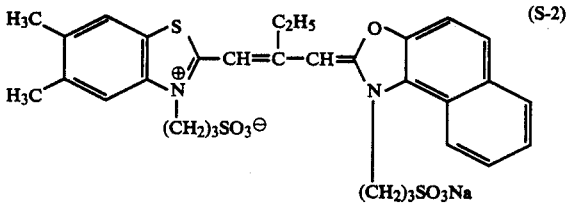

Each of emulsion (c) and emulsion (d) was chemically sensitized with chloroauric acid and sodium thiosulfate for 40 minutes at 60° C. so that each emulsion had maximum sensitivity. Thus, light-sensitive silver iodobromide emulsions (IIc) and (IId) were obtained. After chemical sensitization, sensitizing dye (S-2) was added to emulsion (IIc) in an amount of $3.0\times10^{-4}$ mol per mol of the silver halide in the form of a methanol solution, whereby emulsion (IIc) was reopened for 10 minutes at 40° C. for spectral sensitization.

4-Hydroxy-6-methyl-1,3,3a,7-tetraazaindene was added to each of emulsions (IIc) and (IId) as a stabilizer in an amount of $3.0\times10^{-3}$ mol per mol of the silver halide, and then an aqueous solution of compound (A-2) as an LC dye was added thereto in concentration (per the dry amount of the binder gelatin) of 1 mmol/dm$^3$, 2 mmol/dm$^3$, 10 mmol/dm$^3$ or 20 mmol/dm$^3$.

A conventional coating assistant agent and gelatin were added to the emulsion thus sensitized by light-colleting sensitization, and the resulting emulsion was uniformly coated on a polyethylene terephthalate support in an amount of 2.2 g/m$^2$ as silver or in an amount of 2.5 g/m$^2$ as gelatin and dried to obtain various light-sensitive emulsion-coated samples. The fluorescent quantum efficiency of the LD dye (A-2) as used herein, in a concentration of $10^{-4}$ mol/dm$^3$ in a dry gelatin film, was 0.9, and the Stokes' shift under the same concentration condition was 13 nm.

Each sample was exposed to a white light from a 1 kw tungsten lamp (color temperature: 4,800° K.) through an optical wedge for 1/100 second on the one hand and was exposed to a monochromatic light through an interference filter of 500 nm wavelength, which is involved in the light absorption of the LC dye (A-2), for 1,10 second. On the other hand, the thus-exposed samples were developed in the same manner as in Example 1. By the development, the LC dye (A-2) was completely washed out of the sample and removed therefrom.

The relative sensitivities of the negative images obtained as a result of the development were as shown in Table 2 below for comparison with each other. In the two emulsion series, the relative sensitivity of a sample is a relative value of the reciprocal of the exposure capable of giving a density of (fog density+0.2) on the basis of the standard value (100) of Samples (21) and (26).

The results of Table 2 indicate that in both the emulsion (IIc) series which had been spectrally sensitized after the formation of the grains in a conventional manner and emulsion (IId) series which had been spectrally sensitized by adding the sensitizing dye during the formation of the grains, the resulting spectral sensitivity remarkably increased because of the noticeable light-collecting sensitization of LC dye (A-2), which had been added to the gelatin in a concentration of 2 mmol/dm$^3$ or more. Comparing the emulsion (IId) series of the present invention and the emulsion (IIc) series formed by a conventional method, the effect of the light-collecting sensitization of the former was extremely large as compared to the latter in every concentration of the dye added, and therefore, it is apparent that the light-collecting sensitization by the technique of the present invention is especially advantageous. In present Example 2, the light-collecting sensitization effect of LC dye (A-2) used extended over the blue range of from 460 to 470 nm, which means that LC dye used was also effective for spectral sensitization of the blue color range.

TABLE 2

| Sample No. | Emulsion | LC Dye | Concentration of LC Dye in Gelatin (mmol/dm$^3$) | Relative Sensitivity White Light | Relative Sensitivity 530 nm |
|---|---|---|---|---|---|
| 21 (Comparison) | IIc | None | — | 100 | 100 |
| 22 (Comparison) | IIc | A-2 | 1 | 100 | 102 |
| 23 (Comparison) | IIc | A-2 | 2 | 102 | 126 |
| 24 (Comparison) | IIc | A-2 | 10 | 110 | 200 |
| 25 (Comparison) | IIc | A-2 | 20 | 120 | 280 |
| 26 (Comparison) | IId | None | — | 100 | 100 |
| 27 (Comparison) | IId | A-2 | 1 | 100 | 105 |
| 28 (Invention) | IId | A-2 | 2 | 107 | 150 |
| 29 (Invention) | IId | A-2 | 10 | 120 | 280 |
| 20 (Invention) | IId | A-2 | 20 | 140 | 302 |

Maximum Absorption Wavelength of Sensitizing Dye (S-2): 610 nm
Maximum Emission Wavelength of LC Dye (A-2): 520 to 550 nm (This is shifted to the longer wavelength side with elevation of the concentration.)

EXAMPLE 3

38.0 ml of an aqueous solution containing 1.0 mol/liter of $AgNO_3$ and an aqueous solution containing 1.0 mol/liter of KBr were simultaneously added to 1.0 liter of an aqueous solution containing 0.1 mol of $NH_3$, 0.1 mol of $NH_4NO_3$, 1.4 mmol of KBr and 30 g of gelatin, by a conventional double jet method over a period of 2 hours, at 50° C., with stirring. During the addition, the flow rate of the KBr-containing solution was controlled so that the pAg in the reaction system was kept at 8.3. An appropriate amount of $AgNO_3$ was added so that the pAg was adjusted to 7.4, and then 714.0 mol of an aqueous solution containing 1.0 mol/liter of $AgNO_3$ and an aqueous solution containing 1.0 mol/liter of KBr were simultaneously added over a period of 38 minutes, with controlling the flow rate of the KBr-containing solution so that the pAg of the reaction system was kept at 7.4, to obtain a monodispersed emulsion (I) containing cubic AgBr grains having a mean grain edge length of 0.7 μm.

Emulsion (I) was divided into two parts, and one was chemically sensitized with sodium thiosulfate added thereto in an amount of about 0.3 mg per gram of silver, at 56° C., for 40 minutes to obtain the maximum sensitivity. This was designated as light-sensitive emulsion (IA). The other was first ripened by the addition of 45 ml of a methanol solution containing 0.004 mol/liter of sensitizing dye (S-1) thereto, at 56° C., for 30 minutes with stirring, and then chemically ripened with sodium thiosulfate added thereto in an amount of about 0.15 mg per gram of silver, for a further 40 minutes at the same temperature to obtain the maximum sensitivity. This was designated light-sensitive emulsion (IB). For emulsion (IA), sensitizing dye (S-1) was added thereto, after the chemical sensitization, in an amount of $3.0\times10^{-4}$ mol per mol of AgBr in the form of a methanol solution, whereby emulsion (IA) was ripened for 10 minutes at 40° C. for spectral sensitization.

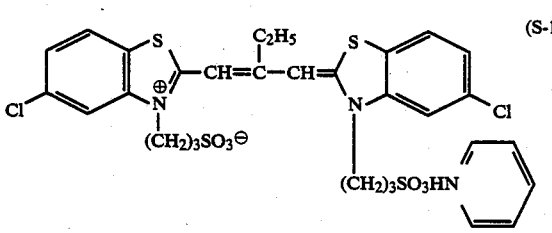

(S-1)

4-Hydroxy-6-methyl-1,3,3a,7-tetraazaindene was added to each of emulsion (IA) and emulsion (IB) as a stabilizer in an amount of $2.5\times10^{-3}$ mol per mol of AgBr, and then an aqueous solution of the compound (A-47) as an LC dye was added thereto in a concentration (per the dry amount of the binder gelatin) of 1 mmol/dm³, 2 mmol/dm³, 10 mmol/dm³ or 20 mmol/dm³. A conventional coating assistant agent and gelatin were added to the emulsion thus sensitized by light-collecting sensitization and the resulting emulsion was uniformly coated on a polyethylene terephthalate support in an amount of 2.0 g/m² as silver or in an amount of 4.0 g/m² as gelatin and dried to obtain various light-sensitive emulsion-coated samples. The fluorescent quantum efficiency of LC dye (A-47) as used herein, in a concentration of $10^{-4}$ mol/dm³ in a dry gelatin film, was 0.8, which was measured by means of the earlier described method. The Stokes' shift of the light emission under said condition was 13 nm.

Each sample was exposed to a white light from a 1 kw tungsten lamp (color temperature 4,800° K.) through an optical wedge for 1/10 second on the one hand and was exposed to monochromatic light through an interference filter of 530 nm wavelength, which is involved in the light absorption band of LC dye (A-47), for 1 second on the other hand, and the thus exposed samples were developed with a developer having the composition now given for 10 minutes at 20° C. By the development, LC dye (A-47) was completely washed out of the sample and removed therefrom with no after color.

| Composition of Developer: | |
|---|---|
| Metol | 2.5 g |
| L-Ascorbic Acid | 10.0 g |
| Nabox | 35.0 g |
| Potassium Bromide | 1.0 g |
| Water to make | 1.0 liter |

The sensitivity of the negative image obtained as a result of the development was as shown in Table 3, together with the amount of the LC dye added to each sample. In the two emulsion series, the relative sensitivity of the sample means the relative value of the reciprocal of the exposure capable of giving a density of (fog density +0.2) on the basis of the standard value (100) of sample (31) and sample (36).

The results of Table 3 indicate that in both emulsion (IA) series which had been spectrally sensitized after the chemical ripening in a conventional manner and emulsion (IA) series which had been spectrally sensitized by adding the sensitizing dye during the chemical ripening, the resulting spectral sensitivity increased because of the light-collecting sensitization by LC dye (A-47), which had been added to the gelatin, at a light absorption wavelength 530 nm, and, in particular, the increase of the sensitivity was remarkable in the range of an LC dye concentration of 2 mmol/dm³ or more, and, accordingly, it can be understood that the LC dye used was also remarkably effective for an elevation of white light sensitivity. Comparing emulsion (IB) series of the present invention and emulsion (IA) series formed by a conventional method, the effect of the light-collecting sensitization of the former was extremely large as compared to the latter in every concentration of the dye added, i.e., the light-collecting sensitization could be attained in the former even when the amount of the LC dye added was small. Accordingly, in view of manufacturing cost and rinsing efficiency, it is apparent that the technique of the present invention is especially advantageous for effective and economical light-collecting sensitization.

TABLE 3

| Sample No. | Emulsion | LC Dye | Concentration of LC Dye in Gelatin (mmol/dm³) | Relative Sensitivity White Light | Relative Sensitivity 530 nm |
|---|---|---|---|---|---|
| 31 (Comparison) | IA | None | — | 100 | 100 |
| 32 (Comparison) | IA | A-47 | 1 | 100 | 105 |
| 33 (Comparison) | IA | A-47 | 2 | 103 | 120 |
| 34 (Comparison) | IA | A-47 | 10 | 108 | 178 |
| 35 (Comaprison) | IA | A-47 | 20 | 110 | 200 |

TABLE 3-continued

| Sample No. | Emulsion | LC Dye | Concentration of LC Dye in Gelatin (mmol/dm³) | Relative Sensitivity White Light | Relative Sensitivity 530 nm |
|---|---|---|---|---|---|
| 36 (Comparison) | IB | None | — | 100 | 100 |
| 37 (Comparison) | IB | A-47 | 1 | 100 | 105 |
| 38 (Invention) | IB | A-47 | 2 | 105 | 140 |
| 39 (Invention) | IB | A-47 | 10 | 110 | 251 |
| 30 (Invention) | IB | A-47 | 20 | 117 | 280 |

Maximum Absorption Wavelength of Sensitizing Dye (S-1): 655 nm

Maximum Emission Wavelength of LC Dye (A-47): 585 nm to 630 nm (This is shifted to the longer wavelength side with elevation of the concentration.)

EXAMPLE 4

600 ml of an aqueous solution containing 0.59 mol/liter of $AgNO_3$ and an aqueous solution containing 0.57 mol/liter of KBr and 0.024 mol/liter of KI were simultaneously added to 1.3 liters of water containing 0.22 mol of $NH_3$, 0.03 mol of $NH_4NO_3$, 3.3 mmol of KBr and 40 g of gelatin, by a conventional double jet method over a period of 60 minutes, with stirring, at 70° C., and with controlling the flow rate of the potassium halide-containing solution so as to keep the pAg value at 7.86, whereby monodispersed emulsion (II) of octahedral silver iodobromide grains (iodine content 4 mol %) having a mean grain size (as the diameter of the corresponding sphere) of 0.7 μm was obtained.

Emulsion (II) was divided into two parts; one was chemically sensitized with chloroauric acid and sodium thiosulfate for 40 minutes at 60° C. to obtain the maximum sensitivity. This was designated light-sensitive silver iodobromide emulsion (IIC). The other was chemically ripened by the simultaneous addition of 25 ml of a methanol solution containing 0.004 mol/liter of sensitizing dye (S-2) and appropriate amounts of sodium thiosulfate and chloroauric acid, to the emulsion at 60° C., the chemical ripening being carried out for 40 minutes at 60° C. This was designated light-sensitive emulsion (IID). For emulsion (IIC), sensitizing dye (S-2) was added thereto, after the chemical sensitization, in an amount of $3.0\times10^{-4}$ mol per mol of the silver halide in the form of a methanol solution, whereby emulsion (IIC) was ripened for 10 minutes at 40° C. for spectral sensitization.

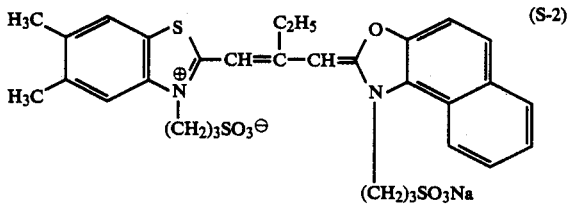

(S-2)

4-Hydroxy-6-methyl-1,3,3a,7-tetraazaindene was added to each of emulsions (IIC) and (IID) as a stabilizer in an amount of $3.0\times10^{-3}$ mol per mol of the silver halide, and then an aqueous solution of compound (A-2) as an LC dye was added thereto in a concentration (per the dry amount of the binder gelatin) of 1 mmol/dm³, 2 mmol/dm³, 10 mmol/dm³ or 20 mmol/dm³.

A conventional coating assistant agent and gelatin were added to the emulsion thus sensitized by light-collecting sensitization, and the resulting emulsion was uniformly coated on a polyethylene terephthalate support in an amount of 2.2 g/m² as silver or in an amount of 2.5 g/m² as gelatin and dried to obtain various light-sensitive coated emulsion samples. The fluorescent quantum efficiency of LC dye (A-2) as used herein, in a concentration of $10^{-4}$ mol/dm³ in a dry gelatin film, was 0.9, and the Stokes' shift at the same concentration was 13 nm.

Each sample was exposed to a white light of a 1 kw tungsten lamp (color temperature 4,800° K.) through an optical wedge for 1/100 second on the one hand and was exposed to a monochromatic light through an interference filter of 500 nm wavelength, which is involved in the light absorption of the LC dye (A-2), for 1/10 second on the other hand, and the thus exposed samples were developed in the same manner as in Example 3. By the development, LC dye (A-2) was completely washed out of the sample and removed therefrom.

The relative sensitivities of the negative images obtained as a result of the development were as shown in Table 4 below in comparison with each other. In the two emulsion series, the relative sensitivity of the sample means the relative value of the reciprocal of the exposure capable of giving a density of (fog density +0.2) on the basis of the standard value (100) of samples (41) and (46).

The results of Table 4 indicate that in both emulsion (IIC) series which had been spectrally sensitized after the chemical ripening in a conventional manner and emulsion (IID) series which had been spectrally sensitized by adding the sensitizing dye during the chemical ripening, the resulting spectral sensitivity remarkably increased because of the noticeable light-collecting sensitization by LC dye (A-2), which had been added to the gelatin in a concentration of 2 mmol/dm³ or more. Comparing emulsion (IID) series of the present invention and emulsion (IIC) series formed by a conventional method, the effect of the light-collecting sensitization of the former was extremely large as compared to the latter in every concentration of the dye added, and, therefore, it is apparent that the light-collecting sensitization by the technique of the present invention is especially advantageous. In present Example 4, the light-collecting sensitization effect of LC dye (A-2) used extended over the blue range of from 460 to 470 nm, which means that the LC dye used was effective also for spectral sensitization of the blue color range.

TABLE 4

| Sample No. | Emulsion | LC Dye | Concentration of LC Dye in Gelatin (mmol/dm$^3$) | Relative Sensitivity White Light | Relative Sensitivity 530 nm |
|---|---|---|---|---|---|
| 41 (Comparison) | IIC | None | — | 100 | 100 |
| 42 (Comparison) | IIC | A-2 | 1 | 100 | 102 |
| 43 (Comparison) | IIC | A-2 | 2 | 102 | 126 |
| 44 (Comparison) | IIC | A-2 | 10 | 110 | 200 |
| 45 (Comparison) | IIC | A-2 | 20 | 120 | 280 |
| 46 (Comparison) | IID | None | — | 100 | 100 |
| 47 (Comparison) | IID | A-2 | 1 | 100 | 103 |
| 48 (Invention) | IID | A-2 | 2 | 105 | 140 |
| 49 (Invention) | IID | A-2 | 10 | 115 | 251 |
| 40 (Invention) | IID | A-2 | 20 | 135 | 295 |

Maximum Absorption Wavelength of Sensitizing Dye (S-2): 610 nm
Maximum Emission Wavelength of LC Dye (A-2): 520 to 550 nm (This is shifted to the longer wavelength side with elevation of the concentration.)

While the invention has been described in detail and with reference to specific embodiments thereof, it will be apparent to one skilled in the art that various changes and modifications ca be made therein without departing from the spirit and scope thereof.

What is claimed is:

1. A silver halide photographic material containing at least one silver halide emulsion layer, in which (I) the silver halide grains constituting the emulsion layer have been spectrally sensitized by at least one adsorbable spectral sensitizing dye added thereto before the completion of the formation of said grains, and (2) at least one luminous dye which has a quantum efficiency of 0.1 to 1.0 when the concentration thereof in dry gelatin at room temperature is $10^{-4}$ mol/dm$^3$ and which can be substantially completely removed by development is added to a hydrophilic dispersion medium of the silver halide emulsion layer in a concentration of 2.0 mmol/dm$^3$ or more, exclusive of the silver halide grains, in the dispersion medium, which luminous dye is capable of adsorbing visible light and fluorescing in the visible region and in which the luminous dye in the dispersion medium is substantially non-adsorbable and the adsorbability of the dye to the silver halide grains is $5\times10^{-7}$ mol/m$^2$ or less in an aqueous 5% (by weight) gelatin solution of silver bromide grains having a (III) crystal plane at a temperature of 40° C. and a pH value of 6.5±0.05 and a dye concentration of $10^{-4}$ mol/liter of said solution phase.

2. A silver halide photographic material containing at least one silver halide emulsion layer, in which (1) the silver halide grains constituting the emulsion layer have been spectrally sensitized by at least one absorbable spectral sensitizing dye added thereto during the stage from the completion formation of the grains to the completion of the chemical ripening thereof, and (2) at least one luminous dye which has a quantum efficiency of 0.1 to 1.0 when the concentration therein in dry gelatin at room temperature is $10^{-4}$ mol/dm$^3$ and which can be substantially completely removed by development is added to a hydrophilic dispersion medium of the silver halide emulsion layer in a concentration of 2.0 mmol/dm$^3$ or more, exclusive of the silver halide grains, in the dispersion medium, which luminous dye is capable of adsorbing visible light and fluorescing in the visible region and in which the luminous dye in the dispersion medium is substantially non-adsorbable and the adsorbability of the dye to the silver halide grains is $5\times10^{-7}$ mol/m$^2$ or less in an aqueous 5% (by weight) gelating solution of silver bromide grains having a (III) crystal plane at a temperature of 40° C. and a pH value of 6.5±0.05 and a dye concentration of $10^{-4}$ mol/liter of said solution phase.

3. A silver halide photographic material as in any one of claims 1 or 2, in which the luminous dye has a quantum efficiency of 0.3 to 1.0 when the concentration thereof in dry gelatin at room temperature is $10^{-4}$ mol/dm$^3$.

4. A silver halide photographic material as in claim 5, in which the quantum efficiency of the luminous dye is 0.5 to 1.0.

5. A silver halide photographic material as in any one of claims 1 or 2, in which the content of the luminous dye is 10 mmol/dm$^3$ or more in the hydrophilic dispersion medium of said silver halide emulsion layer exclusive of the surfaces of the silver halide grains.

6. A silver halide photographic material as in any one of claims 1 or 2, in which the luminous dye contained in the dispersion medium of the emulsion layer is water-soluble and the solubility of the dye in water is $10^{-2}$ mol/liter or more at 25° C. and pH 7.0.

7. A silver halide photographic material as in any one of claims 1 or 2, in which the luminous dye is a water-soluble cyanine dye.

8. A silver halide photographic material as in any one of claims 1 or 2, in which at least one luminous dye has an emission zone which overlaps with at least a part of the absorption zone of the dye directly adsorbed onto the surfaces of the silver halide grains.

9. A silver halide photographic material as in any one of claims 1 or 2, in which the luminous dye generates an emission with a Stokes' shift (difference in the wavelength between the absorption peak and the emission peak) of up to 40 nm when the concentration of the dye in dry gelatin at room temperature is $10^{-4}$ mol/dm$^3$.

10. A silver halide photographic material as in claim 9, in which the Stokes' shift in the emission by the luminous dye is up to 20 nm.

11. A silver halide photographic material as in any one of claims 1 or 2, in which the luminous dye has a reduction potential in a solution of water/methanol (=1/1, by volume) which is more negative than −1.0V with respect to a saturated calomel reference electrode.

12. A silver halide photographic material as in claim 1, in which the photographic spectral sensitizing dye(s) is(are) added during the stage of the formation of the silver halide grains, which stage is after the formation of stable nuclei of the silver halide grains but before the completion of the addition of 85% by weight of the total silver halide amount.

13. A silver halide photographic material as in claim 1, in which the photographic spectral sensitizing dye(s) is(are) added during the stage of the formation of the silver halide grains, which stage is after the completion of the addition of 85% by weight of the total silver halide amount but before the completion of the addition of the total silver halide amount.

14. A silver halide photographic material as in claim 1, in which the photographic spectral sensitizing dye(s) is(are) added during the stage of the formation of the silver halide grains, which stage is after the completion of the addition of the silver halide but before the beginning of desalting of the silver halide grains.

* * * * *